US011406155B2

(12) United States Patent
Shirion

(10) Patent No.: US 11,406,155 B2
(45) Date of Patent: Aug. 9, 2022

(54) SKI BOOT DEVICE

(71) Applicant: Rony Shirion, Hertfordshire (GB)

(72) Inventor: Rony Shirion, Hertfordshire (GB)

( * ) Notice: Subject to any disclaimer, the term of this patent is extended or adjusted under 35 U.S.C. 154(b) by 3 days.

(21) Appl. No.: 15/558,857

(22) PCT Filed: Mar. 21, 2016

(86) PCT No.: PCT/GB2016/050776
§ 371 (c)(1),
(2) Date: Sep. 15, 2017

(87) PCT Pub. No.: WO2016/147012
PCT Pub. Date: Sep. 22, 2016

(65) Prior Publication Data

US 2018/0070671 A1 Mar. 15, 2018

(30) Foreign Application Priority Data

Mar. 19, 2015 (GB) ..... 1504669

(51) Int. Cl.
*A43B 5/04* (2006.01)

(52) U.S. Cl.
CPC ..... *A43B 5/0419* (2013.01); *A43B 5/0421* (2013.01); *A43B 5/0423* (2013.01)

(58) Field of Classification Search
CPC ..... A43B 5/0472; A43B 5/004; A43B 5/0423; A43B 5/0421; A43B 5/0419; A43B 5/0417; A43B 5/0415; A43B 5/04
(Continued)

(56) References Cited

U.S. PATENT DOCUMENTS 3,665,620 A * 5/1972 St. Clair ..... A43B 3/00 36/7.5
3,971,144 A * 7/1976 Brugger-Stuker ... A43B 5/0419 36/100

(Continued)

FOREIGN PATENT DOCUMENTS

AT 347294 B 12/1978
CH 580927 A5 10/1976

(Continued)

OTHER PUBLICATIONS

Machine translation of DE 2363131, 10 pages.*

*Primary Examiner* — Khoa D Huynh
*Assistant Examiner* — Uyen T Nguyen
(74) *Attorney, Agent, or Firm* — Laubscher & Laubscher, P.C.

(57) ABSTRACT

Ski boot device for ski boots (1). Ski boots have a front sole section (3) with a front interaction surface associated with binding and releasing from a front ski binding, and a rear sole section (4), in a common plane (8), with a rear interaction surface associated with binding and releasing from a rear ski binding. The ski boot device of the present invention is attached to the ski boot and comprises a toe portion formed and attached to the ski boot sole (3) without interfering with the front interaction surface during binding or releasing, a heel portion formed and attached to the heel (4) of the ski boot without interfering with the rear interaction surface during binding or releasing; and a support portion (10A, 10B) provided intermediate the toe portion and heel portion and having a shaped profile which extends below the common plane and provides a contact surface during walking.

6 Claims, 5 Drawing Sheets

(58) Field of Classification Search
USPC ..... 36/132, 100
See application file for complete search history.

(56) References Cited

U.S. PATENT DOCUMENTS 4,098,010 A * 7/1978 Rothmayer ..... A43B 5/0419 280/613
4,245,409 A * 1/1981 Beyl ..... A43B 5/0417 280/613
4,392,666 A * 7/1983 Ramer ..... C10M 137/10 280/614
4,461,104 A * 7/1984 Calkin ..... A43B 5/0419 12/120.5
4,505,057 A * 3/1985 Kiester ..... A43B 5/0419 36/117.4
4,846,492 A * 7/1989 Bataille ..... A63C 9/0846 280/613
5,071,154 A * 12/1991 Szasz ..... A63C 9/005 280/618
5,125,172 A * 6/1992 Iwama ..... A43B 5/0425 280/811
6,402,183 B1 * 6/2002 Marmonier ..... A43B 5/0401 280/607
2001/0010422 A1 * 8/2001 Merino ..... A43B 5/0496 280/624
2002/0017771 A1 * 2/2002 McManus ..... A63C 13/003 280/600
2006/0010719 A1 * 1/2006 Francis ..... A43B 13/182 36/132
2012/0117829 A1 * 5/2012 Lawler ..... A43B 5/0421 36/132
2014/0259795 A1 * 9/2014 Hoth ..... A63C 13/001 36/122

FOREIGN PATENT DOCUMENTS

CH 613867 A5 10/1979
DE 2363131 A1 * 12/1973 ..... A43B 5/04
DE 2363131 A1 * 6/1975 ..... A43B 1/0054
DE 2363131 A1 6/1975
DE 2520183 A1 11/1975
DE 2655564 A1 * 6/1978 ..... A43B 5/0419

* cited by examiner

SKI BOOT DEVICE

This application is a § 371 National Stage Entry of PCT/GB2016/050776 filed Mar. 21, 2016 entitled "Ski Boot Device." PCT/GB2016/050776 claims priority to GB1504669.1 filed Mar. 19, 2015. The entire contents of these applications are incorporated herein by reference in their entireties.

The present invention relates to a ski boot device wearable with a ski boot during both skiing and walking.

Ski boots are formed with a front sole section and a rear sole section in a generally common plane. Ski boots are made to enable releasable engagement with ski bindings mounted on skis so that skis can be put on and taken off for skiing. The ski boots are also made so that they are releasable from the bindings in the event of a skiing mishap.

Modern alpine ski boots have rigid flat soles and attach to a ski through flanges at both the toe and heel using a spring-loaded binding. In this respect, the front sole section is a planar unit and includes a front interaction surface or area associated with binding and releasing from a front ski binding and the rear sole section is a planar unit and includes a rear interaction surface or area associated with binding and releasing from a rear ski binding.

In one example, the front binding of a ski has a left/right movable unlocking portion that unlocks the binding in the event of a fall. This is typically about 60 mm from the front of the ski boot when the front sole section engages with the binding. The rear sole section portion clips into the rear of the binding and engages and presses down on a resilient clip that pushes the boot upwards when the binding is unlocked.

The lower contact surface of such a ski boot presents a flat planar contact surface during walking. Consequently, it is necessary to walk in a rather rigid manner without the usual rolling action associated with walking in shoes. Thus, walking in ski boots is not particularly comfortable, especially since the ski boot itself does not flex. Moreover, walking in slippery conditions is potentially hazardous. To assist with walking in these ski boots, the very front of the front sole section and the very rear of the rear sole section are typically bevelled.

Attachments for ski boots to aid traction when walking are known. For example, crampons are used in winter outdoor pursuits, such as climbing and hiking, for traction on snow and ice, and similar aids for attachment to the sole of a ski boot for improved traction when walking are known, for example detachable rubber soles which attach to the toe and heel portions of the boot.

However, known traction aids for ski boots have the disadvantage that they must be detached from the ski boot in order for the ski boot to be fitted into the bindings of a ski, with the consequent need for storage of the aids during skiing. Then they must be attached again after skiing and prior to walking.

The present invention seeks to provide a ski boot device which can be used with a ski boot during both skiing and walking without the need for detachment or attachment.

According to the present invention there is provided a ski boot device for use with a ski boot during both skiing and walking, wherein the ski boot has a front sole section and a rear sole section in a generally common plane, wherein the front sole section includes a front interaction surface associated with binding and releasing from a front ski binding and the rear sole section includes a rear interaction surface associated with binding and releasing from a rear ski binding, the ski boot device comprising:—a toe portion for attachment to the front of the ski boot and formed to attach without interfering with the front interaction surface during binding or releasing; a heel portion for attachment to the rear of the ski boot and formed to attach without interfering with the rear interaction surface during binding or releasing; and a support portion provided intermediate the toe portion and heel portion and having a shaped profile which extends below said generally common plane and provides a contact surface during walking with the ski boot device attached to the ski boot.

In one embodiment, the support portion has a side member extending along a respective side of the ski boot when the device is attached to the ski boot; wherein each side member has a fixed rear section with the lower surface providing a rear part of said shaped profile; wherein each side member has a front section with the lower surface providing a front part of said shaped profile; and wherein the front section is slidably mounted on the side member to be movable towards the front of the device to a walking position in which the front section interferes with the front interaction surface during binding or releasing and towards the rear of the device to a skiing position in which the front section does not interfere with the front interaction surface during binding or releasing.

Preferably, the ski boot device further comprises a latch arrangement for latching the front section in said walking position and said skiing position.

In one embodiment, a front end of each side member extends to join said toe portion and a rear end of each side member extends to join said heel portion.

Preferably, each side member, toe portion and heel portion comprise an integrally formed unitary member. This makes production simpler.

Conveniently, the toe portion includes front attachment means for fastening the ski boot device to the front of the ski boot and the heel portion includes rear attachment means for fastening the ski boot device to the rear of the ski boot.

Preferably, the front attachment means comprises an adjustable strap arrangement to fasten the toe portion to the front of the ski boot. Consequently, the ski boot device can be used with different sizes of ski boot.

In another preferred embodiment, the rear attachment means comprises a clasping element to receive and engage with the rear of the ski boot.

In yet another preferred embodiment, the clasping element is clasping element is slidably movable towards and away from the rear of the ski boot. Consequently, the ski boot device can be used with different sizes of ski boot.

It is preferred that the ski boot device further comprises a bridge member spans between said side members, generally central to the ski boot when the device is attached to the ski boot, the bridge member providing an additional contact surface during walking. This provides additional integrity to the ski boot device.

In an alternative embodiment, the support portion comprises a side member extending along a respective side of the ski boot when the device is attached to the ski boot, and wherein the lower surface of the side member provides said shaped profile.

Preferably, a front end of each side member extends to join said toe portion and a rear end of each side member extends to join said heel portion.

Conveniently, each side member, toe portion and heel portion comprises an integrally formed unitary member.

In a preferred embodiment, the side members are identical. This makes production of the ski boot device simpler and cheaper.

In one embodiment, the toe portion includes front attachment means to enable screw fixing of the toe portion into the side or lower surface of the front sole section, and the heel portion includes rear attachment means to enable screw fixing of the heel portion into the side or lower surface of the rear sole section.

In another aspect of the present invention, the toe portion is integrally formed with the front sole section of the ski boot and the heel portion is integrally formed with the rear sole section of the ski boot.

Preferably, the ski boot device further comprises a bridge member spanning between said side members, generally central to the ski boot when the device is attached to the ski boot, the bridge member providing an additional contact surface during walking.

It is preferred that said shaped profile comprises a curve.

According to another aspect of the present invention there is provided a ski boot comprising a ski boot device as hereinabove described.

The present invention will now be described in detail with reference to the accompanying drawings, in which.

In the drawings, like numbered components bear the same reference numerals.

Figure 1A:
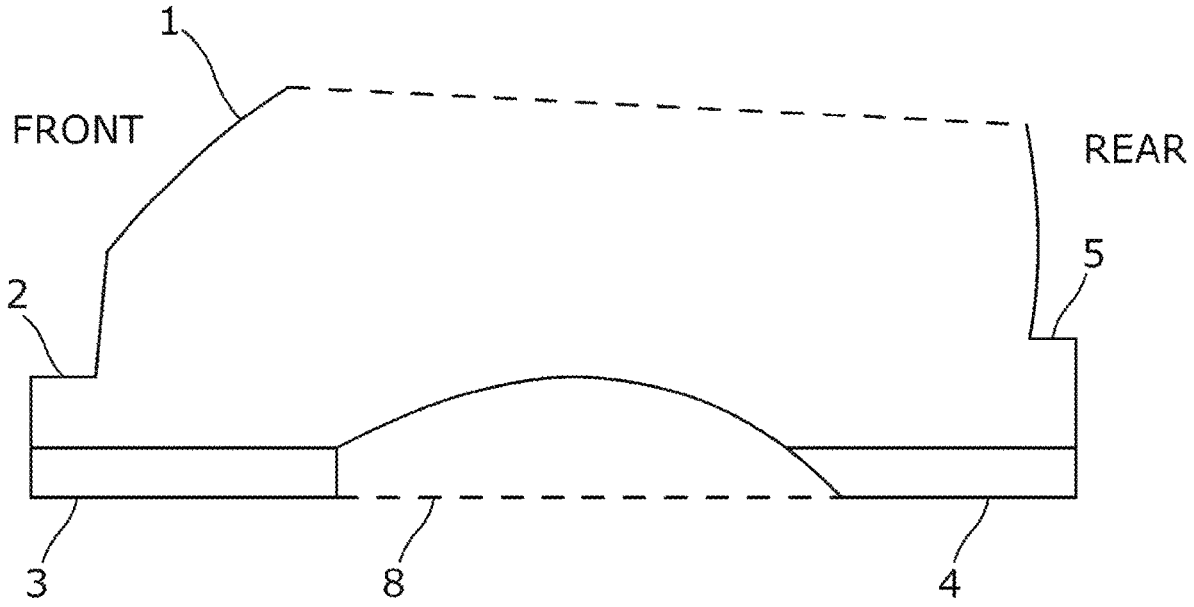
FIG. 1A shows a partial side view of a ski boot.

FIG. 1A shows a partial side view of a ski boot 1 with a front flange 2 for fastening in known manner into a front binding (not shown) mounted on a ski, and with a rear flange 5 for fastening in known manner into a rear binding (not shown) mounted on a ski. The ski boot further includes a front sole section 3 and a rear sole section 4. The front sole section and rear sole section lie in a generally common plane schematically shown by line 8 and the ski boot has a longitudinal axis along its length from front to rear and a transverse axis perpendicular thereto across the width of the ski boot.

Figure 1B:
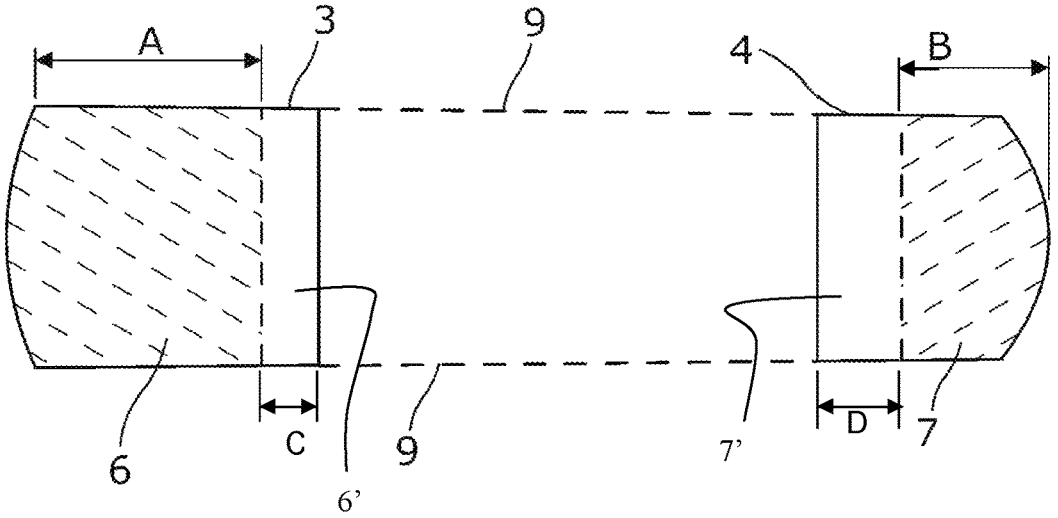
FIG. 1B shows a view of the ski boot from below without the main body of the ski boot.

FIG. 1B is a view of the ski boot from below showing just the lower surface of the front sole section and rear sole section, the common plane being the plane of the paper. FIG. 1B also shows a hatched area 6 which comprises the front interaction surface of the front sole section which can be acted on by the front binding during a binding or release operation. The hatched area 6 extends by a longitudinal distance A from the front edge of the front sole section and forms a front portion of the front sole section. A rear portion 6' of the front sole section extends a longitudinal distance C from the rear edge of the front sole section. FIG. 1B further shows a hatched area 7 which comprises the rear interaction surface of the rear sole section which can be acted on by the rear binding during a binding or release operation. The hatched area 7 extends by a longitudinal distance B from the rear edge of the rear sole section and defines a rear portion of the rear sole section. An unhatched area 7' extends by a longitudinal distance D from the front edge of the rear sole section to the hatched area 7 and defines a front portion of the rear sole section. The distances A and B are typically in the range from 50 to 100 mm, for example 60 to 90 mm, depending on the type of binding on the ski. It can also be seen from the dotted line 9 that the front sole section 3 and rear sole section 4 together with the dotted line define a lower perimeter or footprint of the ski boot.

It will be appreciated that there are many types of ski boots and ski bindings. The present invention relates to ski bindings which have front and rear bindings into which the ski boot is mounted. Whilst the front sole section and rear sole section are shown as solid surfaces, it will be appreciated that the soles can comprise a series of transverse ridges or other profiling.

Figure 2:
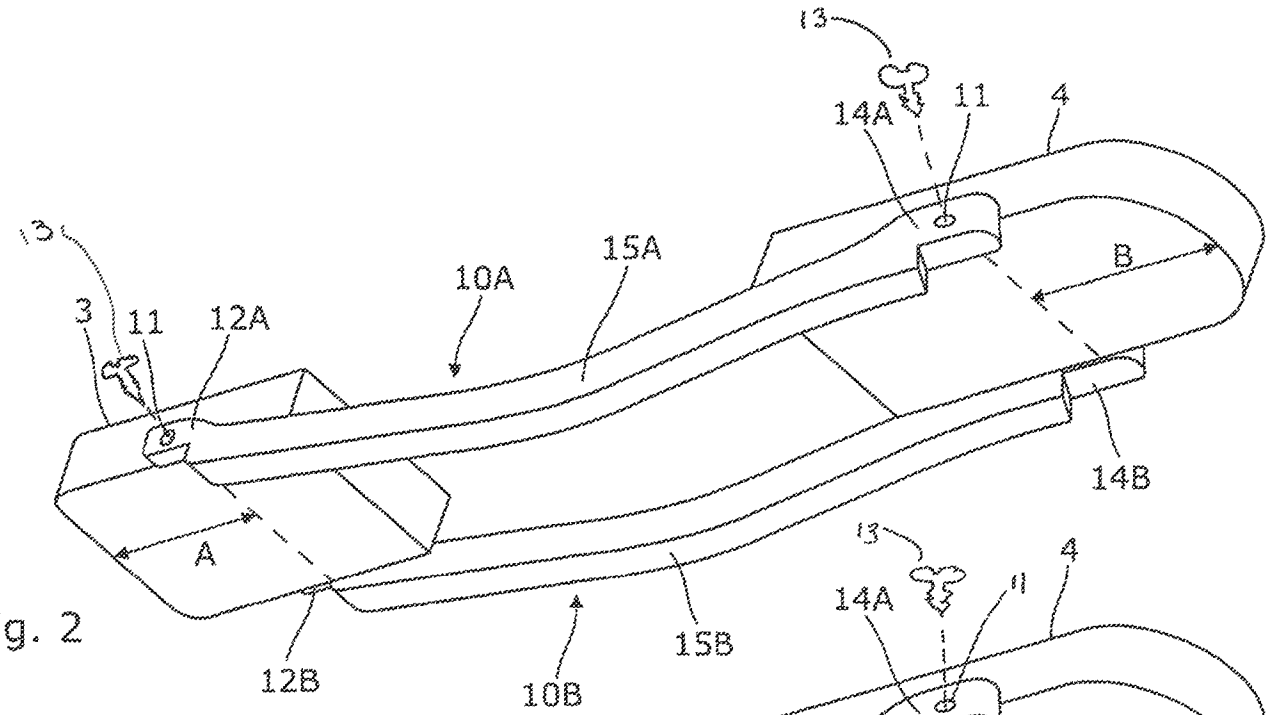
FIG. 2 shows a perspective view from below of a first embodiment of a ski boot device of the present invention attached to the front and rear sole sections of the ski boot shown in FIG. 1A.

FIG. 2 shows a perspective view from below of a first embodiment of a ski boot device of the present invention. The ski boot device comprises an integrally formed first side member generally identified by the reference number 10A and an integrally formed mirror image second side member generally identified by the reference number 10B. Each side member 10A and 10B has a generally square cross section, like a rail, with a front end portion (a toe portion) 12A, 12B having a flattened profile on a forward lower surface and a rear end portion (a heal portion) 14A, 14B having a flattened rear profile on the lower surface. Each side member 10A, 10B includes an intermediate portion 15A, 15B (support portion) intermediate the front end portion and rear end portion which has a shaped profile in the form of a curve.

Each end portion 12A, 12B, 14A, 14B includes a transverse aperture 11 which provides an attachment means. Accordingly, a screw 13 can be inserted through the aperture 11 in the front end portion 12A, 12B of each side member so it can be screwed into the side of the front sole section 3 with the flattened profile on the lower surface lying in the plane 8. It will be seen that the longitudinal dimensions of the intermediate portions 15A and 15B are selected such that they, together with flattened profile of the end portions 12A, 12B, do not interfere with the interaction surface of the front sole section. Thus, a release operation of the front binding is not inhibited.

Similarly, a screw 13 can be inserted through the aperture 11 in the rear end portion 14A, 14B of each side member so it can be screwed into the side of the rear sole 4 with the flattened profile on the lower surface lying in the plane 8. It will be seen that the longitudinal dimensions of the intermediate portions 15A and 15B are selected such that they, together with flattened profile of the end portions 14A, 14B, do not interfere with the interaction surface of the rear sole section. Thus, a release operation of the rear binding is not inhibited.

It will be seen that the shaped profile of the intermediate portions 15A and 15B extends below the plane 8. Consequently, when the ski boot device is screwed to the front and rear sole sections as above and a user walks, the intermediate portions function as a support portion for the ski boot device and the lower surfaces of the intermediate portions contact the surface on which the user is walking. Moreover, due to the curved profile, easier walking is facilitated with the ski boot in comparison with walking in the ski boot with just the front sole section and rear sole section. In addition, the curved profile is chosen such that it does not interfere with skiing when the ski boot is fixed in the ski bindings. Finally, the intermediate portions 15A and 15B lie outside the lower perimeter of the ski boot described with reference to FIG. 1B.

The form of shaped profile of the intermediate portions is selected to enable walking in ski boots more comfortable, convenient and easier than without the ski boot device attached to the ski boot. The profile can therefore take many different forms. For example, the profile can be symmetrical relative to the toe and heel portion such that the two side members can be identical. Moreover, the lower surface of the intermediate portions does not have to be a continuous surface but can instead can have lateral ridges or a castellated appearance.

Figure 3:
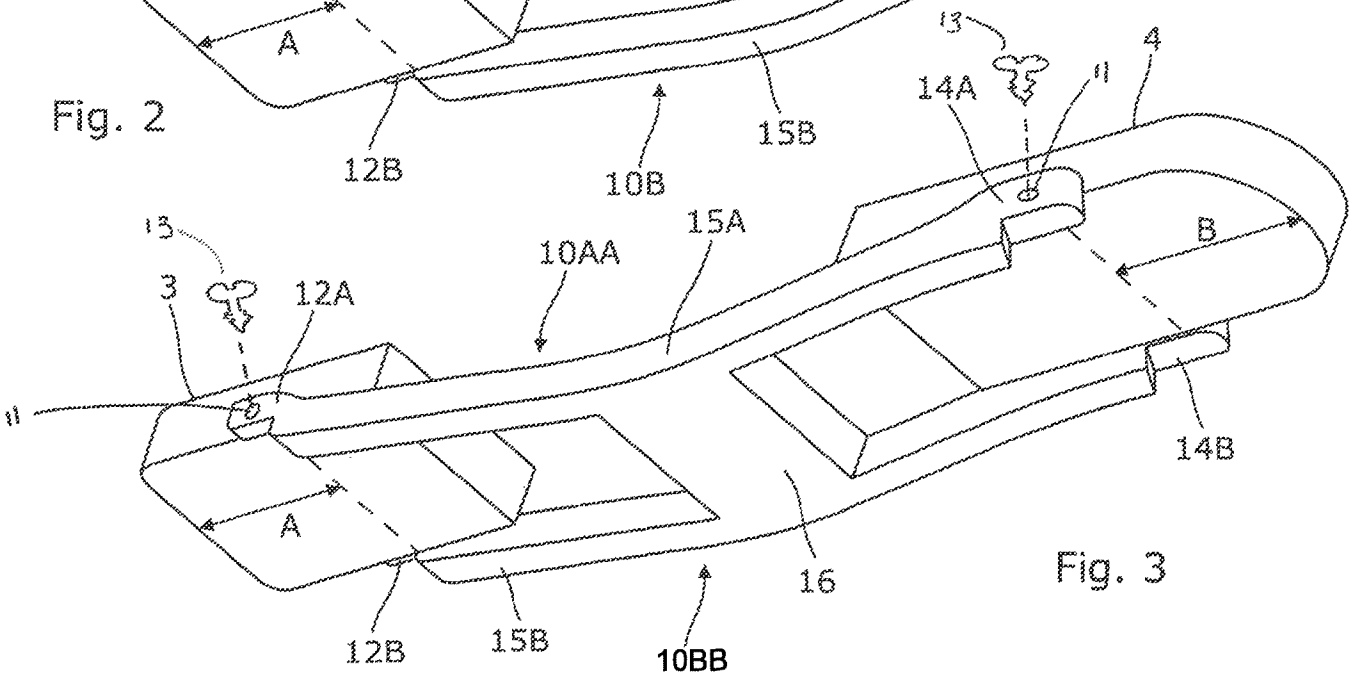
FIG. 3 shows a perspective view from below of a second embodiment of a ski boot device of the present invention attached to the front and rear sole sections of the ski boot shown in FIG. 1A and having a central bridge portion.

FIG. 3 shows a perspective view from below of a second embodiment of a ski boot device of the present invention which is similar to the embodiment shown in FIG. 2 except that it has a bridge portion 16 spanning between the intermediate portions 15A and 15B approximately midway between the end portions 12A, 12B and 14A, 14B. By having a bridge portion, a further lower contact surface is provided during walking with a ski boot having the ski boot device attached. In addition to providing extra support for the person walking in the ski boot, it also assists with the integrity of the ski boot device. The bridge portion 16 does not interfere with a release operation of the binding of a ski because it does not extend into the interaction surfaces associated with the front and rear sole sections. The side members 10A and 10B together with the bridge portion 16 are preferably formed as an integral single piece device although the bridge portion can be fixed to the side members by other means which will be readily apparent to the person skilled in the art.

Figure 4A:
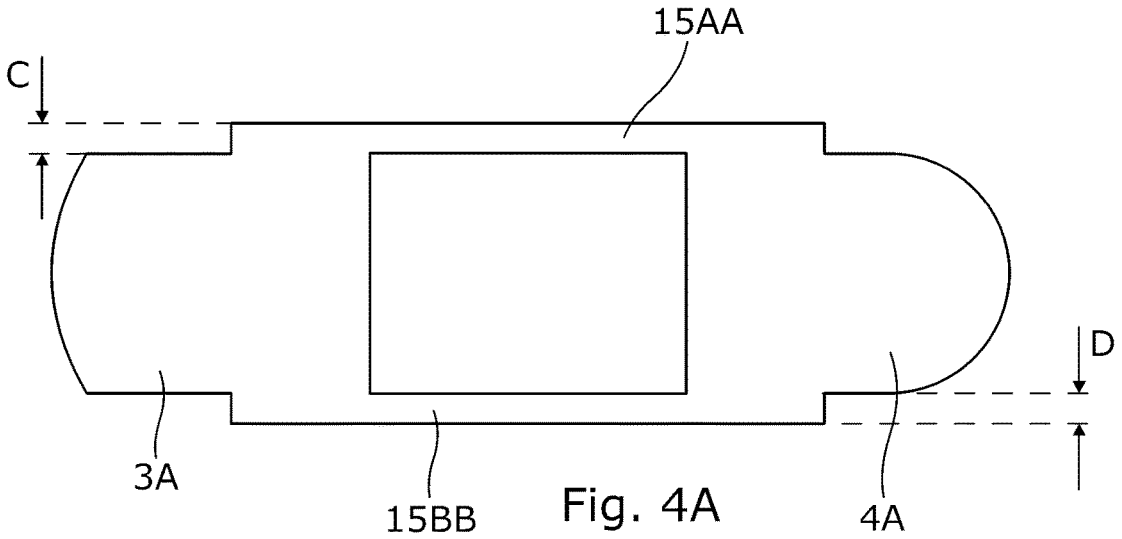
FIG. 4A shows a plan view from below of a third embodiment of a ski boot device of the present invention which is integrally formed with the front and rear sole sections of the ski boot shown in FIG. 1A.
Figure 4B:
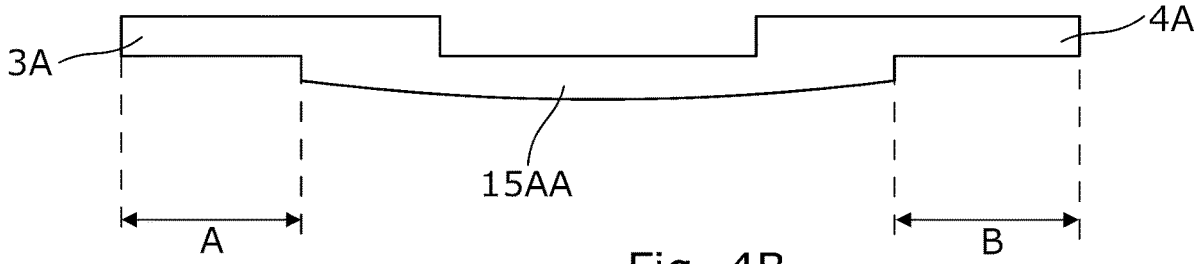
FIG. 4B shows a side view of the ski boot device shown in FIG. 4A.

FIG. 4A shows a plan view from below of a third embodiment of a ski boot device of the present invention which is integrally formed with the front and rear sole sections and FIG. 4B shows a side view of the ski boot device of FIG. 4A. With the first and second embodiments described above, the ski boot device is screwed into the sides of the front sole section and rear sole section. The third embodiment is similar to the first embodiment except that the end portions of the side members are integrally formed with the front sole section and rear sole section.

Thus, the front end portion described above is formed integrally with the part of the front sole section remote from the front to form a combined front end portion and front sole section 3A. Similarly, the rear end portion described above is formed integrally with the part of the rear sole section remote from the rear to form a combined rear end portion and rear sole section 4A. Intermediate support portions 15AA and 15BB extend from these combined parts 3A and 4A and have a shaped profile as with the first and second embodiments. Other aspects of the third embodiment are also the same. In this respect, it can be seen that the intermediate support portions, as with the first and second embodiments, extend longitudinally along the outside perimeter defined by the front sole section and rear sole section by an amount which will not interfere with the skiing action of a user when wearing skis, for example by contacting the snow when performing carving turns. These lateral extensions are shown as distances C and D in FIG. 4A and may be from 0 to 10 mm. It is apparent that the ski boot device of this embodiment is preferably an integrally formed single piece device. The ski boot device of this embodiment can be attached to the remainder of the ski boot in conventional manner, as is well known to those skilled in the art.

Figure 5:
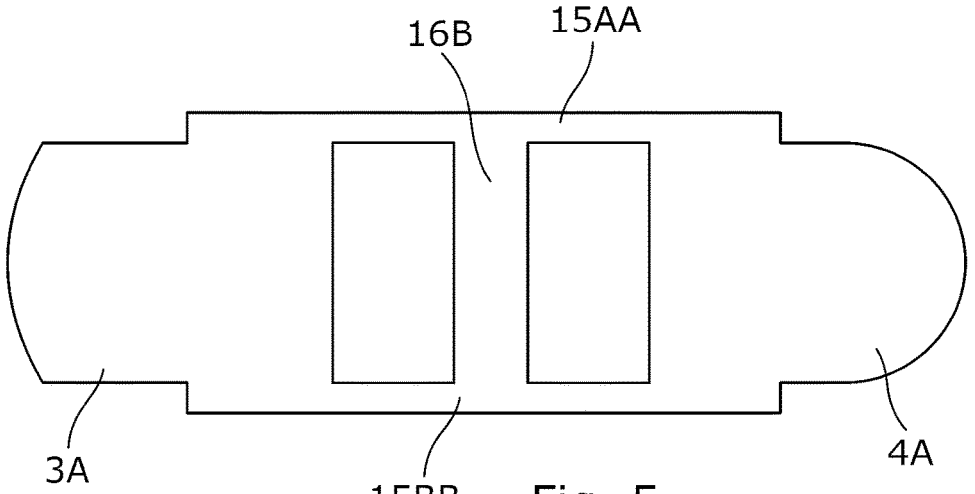
FIG. 5 shows a view from below of a fourth embodiment of a ski boot device of the present invention which is integrally formed with the front and rear sole sections of the ski boot shown in FIG. 1A and having a central bridge portion.

FIG. 5 shows a plan view of a fourth embodiment of a ski boot device of the present invention which is similar to the embodiment shown in FIGS. 4A and 4B except that it has a bridge portion 16A spanning between the intermediate support portions 15AA and 15BB at a position approximately midway between the front sole section 3A and rear sole section 4A. As with the embodiment shown in FIG. 3, by having a bridge portion, a further lower contact surface is provided during walking with a ski boot having the ski boot device and it also assists with the integrity of the ski boot device.

It will be apparent that instead of the bridge member 16B in FIG. 5, the bridge member can be omitted along with a central part of the intermediate support portions 15AA and 15BB such that the ski boot device is formed of a first integrally formed single piece device comprising the front sole section 3A and forward parts of the intermediate portions 15AA and 15 BB and a second integrally formed single piece device comprising the rear sole section 4A and rearward parts of the intermediate portions 15AA and 15BB.

It will be apparent that the ski boot devices described above tend to be appropriate to certain types and sizes of boots and bindings. In order to provide a more universal ski boot device of the present invention, the fifth embodiment shown in FIGS. 6 to 11 has been developed which enables the ski boot device of the present invention to be used with different types of binding and different sizes of ski boots.

Figure 6:
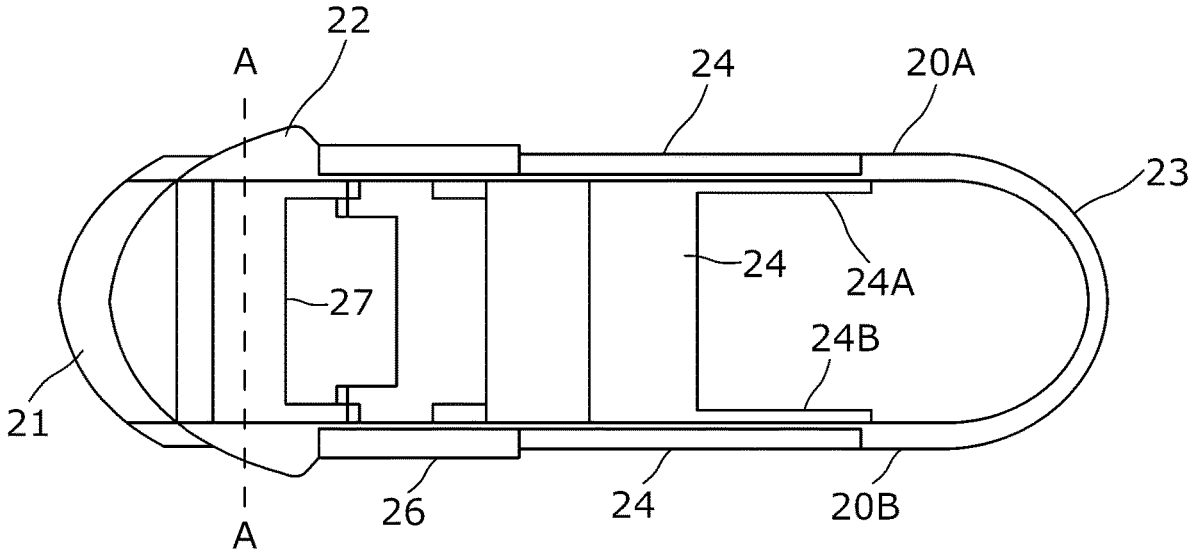
FIG. 6 shows a plan view from above of a fifth embodiment of a ski boot device of the present invention.

Referring to FIGS. 6 to 11, a frame is formed to have a pair of parallel side members 20A, 20B which provide a support portion for the ski boot device. At the toe portion towards the front end, the side members extend towards each other in a curved manner to define a toe portion in the form of a flat curved plate 21 as shown in FIG. 6. Just to the rear of the flat curved plate, a front boot holder 22 extends upward from the upper surface of the side members in a loop, as can be seen in the cross section shown in FIG. 9. The front boot holder 22 has a profile corresponding to the front portion of a ski boot. This forms a front attachment means for fastening the ski boot device to the front of the ski boot. The front boot holder is open at the front so that the front of the ski boot can be inserted into the curved front boot holder with the very front of the front sole section of the ski boot resting on the flat curved plate 21 with the front flange 2 of the ski boot able to engage the front binding of a ski. The lower portion of the ski boot is shown in dotted outline in FIG. 7.

It can be seen that the lower surface of the flat curved plate provides a support for the front of the ski boot but is dimensioned such that it and the front boot holder do not interfere with the front interaction surface so as not to interfere with a release operation of the front binding. Instead, an open area is provided in the region of the front sole section so there will not be any interference with a release operation of a binding. In this respect, the gap to the front section described below is a minimum of 130 mm to ensure a release operation of the front binding in the event of an accident.

In a preferred embodiment, the front boot holder 22 is adjustable by having an adjustable strap arrangement to fasten the toe portion to the front of the ski boot. For example, it can be a flexible looped member comprising two parts which overlap each other with a cooperative velcro layer on each part to enable the length of the front boot holder to be varied for different size ski boots and yet hold the ski boot tightly. Alternatively, the flexible member can be in the form of a strap which cooperates with a ratchet mechanism to enable the length of the strap to be varied and yet tensioned. The person skilled in the art will be aware that the strap and ratchet mechanism can be similar to that used for buckles on ski boots.

Figure 10:
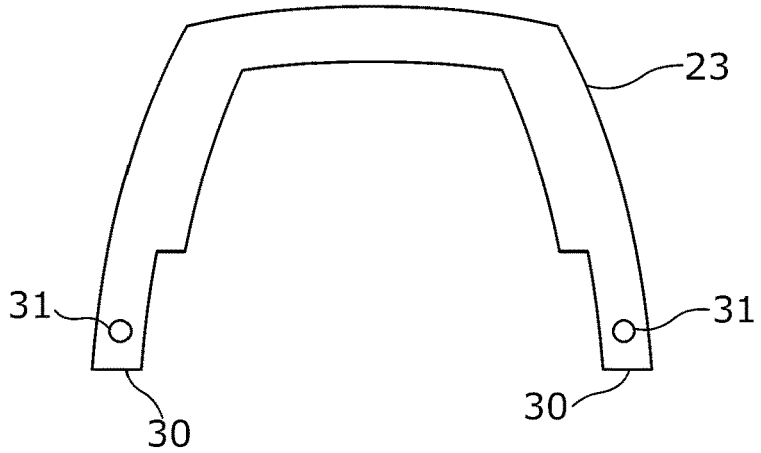
FIG. 10 shows a rear view of the rear attachment means of the ski boot device of FIG. 6.

At the heel portion towards the rear end, the side members extend towards each other in a curved manner and upwards to define a heel portion in the form of a curved rear boot holder 23. The rear boot holder 23 has a profile corresponding to the rear portion of a ski boot, as can be seen in FIG. 10. This forms a rear attachment means for fastening the ski boot device to the rear of the ski boot. The lower surface 30 of the rear boot holder 23 is substantially flat in the region of the rear sole section, in the same plane as the flat curved plate 21, and is open at the rear so that the rear of the ski boot can be inserted into the rear boot holder with the rear flange 5 of the ski boot able to engage the rear binding of a ski. The lower portion of the ski boot is shown in dotted outline in FIG. 7. It will be noted that the rear boot holder 23 does not interfere with a release operation of the rear binding as it does not interfere with the rear interaction surface. Instead, an open area is provided in the region of the rear sole section so there will not be any interference with a release operation of the binding.

In a preferred embodiment, the rear boot holder 23 acts as a clasping element to hold the rear of the ski boot. Moreover, it is preferably adjustable. In such an embodiment, the rear boot holder 23 comprises a separate element from the side members 20A, 20B. The rear boot holder 23 can then be attached to the ends of the side members 20A, 20 by longitudinal bolts (not shown) inserted through apertures 31 formed in the rear of the rear boot holder. The bolts can then screw into bolt receivers (not shown) formed in the rear ends of the side members 20A, 20B. In this way, the rear boot holder can be connected to the side members 20A and 20B and moved longitudinally by turning and adjusting the bolts. Thus, an adjustable arrangement is provided to fasten the heel portion to the rear of the ski boot. Alternative arrangements for connecting the rear boot holder to the side members in an longitudinally adjustable manner can be devised, the details of which will be readily apparent to those skilled in the art.

Figure 9:
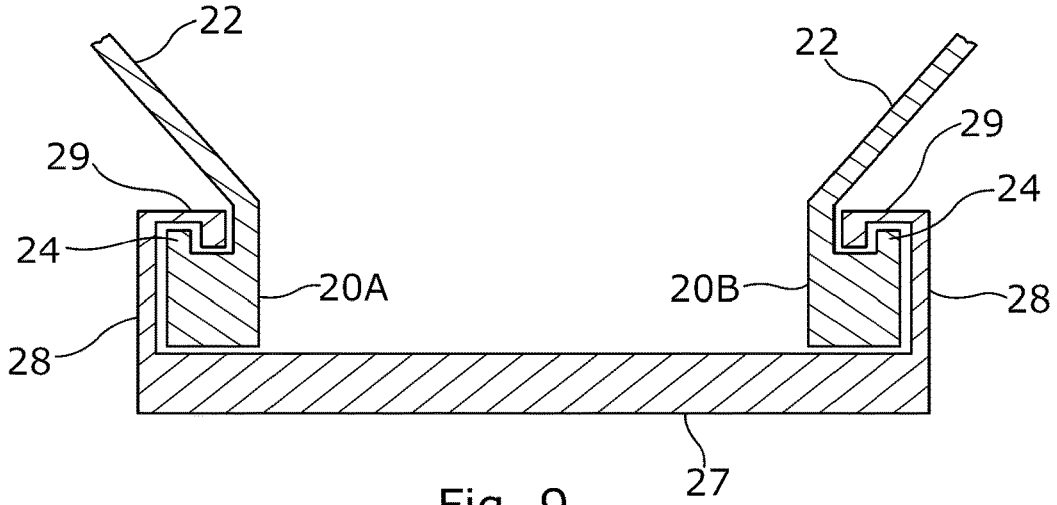
FIG. 9 shows a section along the line A-A in FIG. 6.

The upper surface of each side member 20A, 20B is formed with a longitudinal rail 24 on the outer peripheral edge of the frame as can be seen in FIGS. 6 and 9. The rails 24 extend from the front end of the side members 20A, 20B, where they extend to form the toe portion, to a position at the heel portion where the rear portion (the rear boot holder) meets the side members.

The frame is formed with a bridge portion 24 spanning between the side members 20A, 20B at a position slightly to the rear of a substantially central midpoint between the front and rear of the side members 20A, 20B. The bridge portion includes rearward extending arms 24A and 24B integrally formed with the side members to provide an additional support surface for when the ski boot device is mounted to and worn on a ski boot. It will be noted however that the arms 24A and 24B do not extend to a position where they could interfere with the rear interaction surface. Indeed, with the frame formed in this way, an open area is provided in the region of the rear sole section so there will not be any interference with a release operation of a binding.

The lower surfaces of the side members extend from the position where they meet the rear boot holder to the position substantially central between the front and rear of the side members 20A, 20B and have a curved profile portion which is a similar profile to that shown in the other embodiments. This part of the frame forms a rear section 25 of the support portion provided by the side members 20A and 20B. The lower surfaces of the forward part of the side members is substantially flat and is in the same plane as the lower surface of the front plate 21 and the lower surface 30 of the rear boot holder 23. Preferably the frame as described above is formed as a single integrally formed piece.

Figure 11:
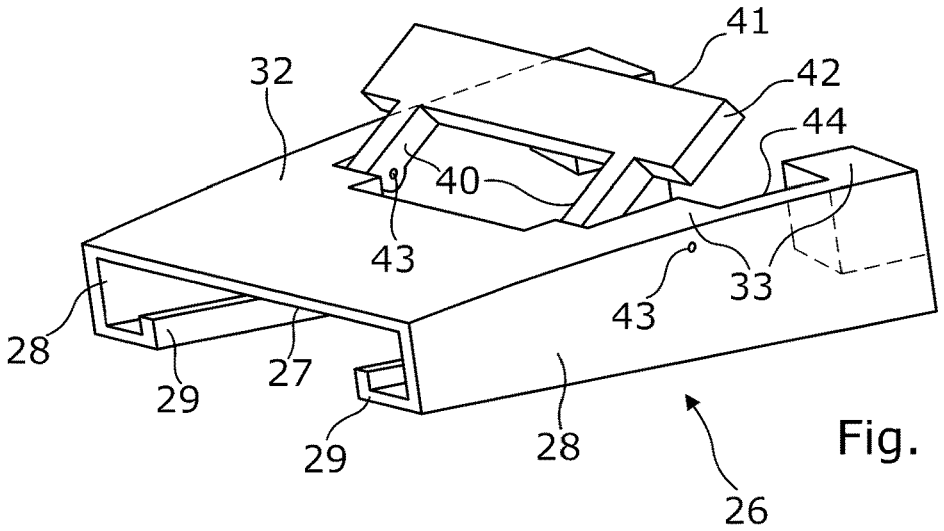
FIG. 11 shows a perspective view from below of a slidable front section of the support portion and a latch arrangement.

A single piece integrally formed front section 26 of the support portion, shown particularly in FIG. 11, is formed by a base 27 having side pieces 28, which each have an overturned lip 29 at the upper end. The width of the base 27 matches the width between the side members 20A and 20B. The base has a front part 32 which extends fully from the side pieces to span the space between the side pieces, and a rear part 33 which extends only partly from both of the side pieces. Overall, the front and rear parts of the base provide a curved lower profile in a longitudinal direction, as shown in FIG. 11, which matches the curved profile of the rear section 25. The base 27 has a planar upper profile so that the gap between this upper profile and the overturned lips 29 matches the height of the forward part of the side members whereby the front section 26 can snugly slide onto the side members 20A, 20B from the front with the overturned lips 29 engaging with the rails 24 and with the aforementioned planar upper profile of the base engaging the lower flat surface of the side members. Consequently, the front section 26 can slide longitudinally along the side members from a front walking position shown in FIG. 7 to a rear skiing position shown in FIG. 8.

Figure 7:
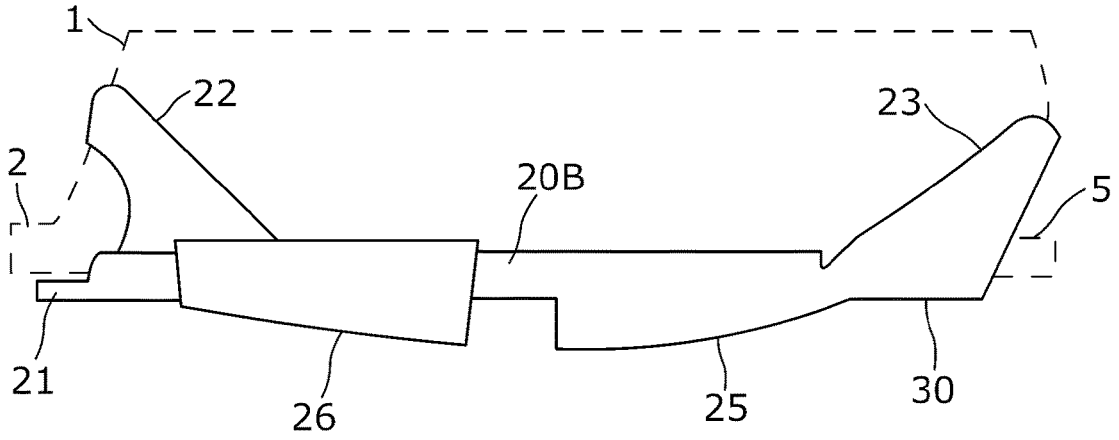
FIG. 7 shows a side view of the embodiment shown in FIG. 6 with a movable front section of the support portion in a walking position.
Figure 8:
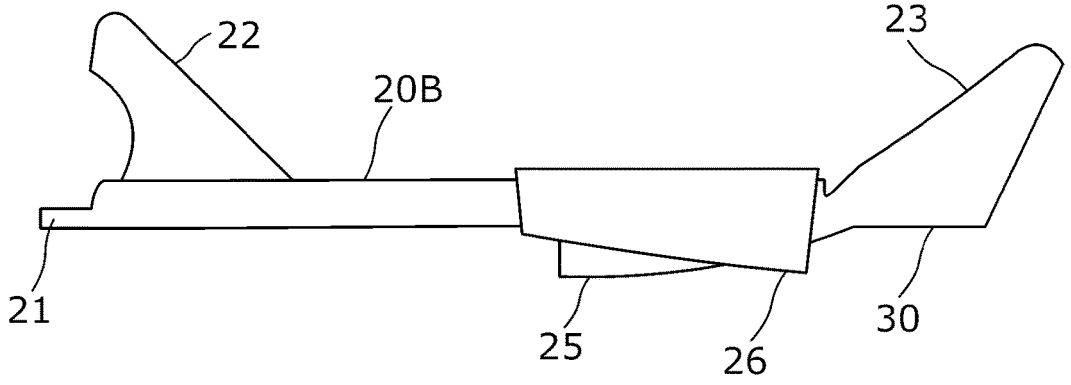
FIG. 8 shows a side view of the embodiment shown in FIG. 6 with the front section of the support portion in a skiing position.

With this embodiment of the invention, the curved profile of the support portion of the above described embodiments is formed by the rear section integrally formed as part of the side members 20 A and 20B, and the slidable front section when the front section is in the front position shown in FIG. 7 which comprises the position for walking. Whilst in this position, the front section would interfere with the front interaction surface. However, the front section can be moved longitudinally to a position adjacent the heel portion, shown in FIG. 8, which does not interfere with the front or rear interaction surfaces. This comprises the position for skiing.

As shown in FIG. 11, a latch arrangement is provided for latching the front section in the walking position or the skiing position. The latch arrangement comprises a latch member formed with a pair of longitudinal and forward facing arms 40 extending from a transverse connecting member 41. Each arm includes a pin 43 to connect the arms 40 to the side pieces 28 of the front section 26 so that the latch arrangement can pivot about the pins. The transverse connecting member 41 includes upstanding latch brackets 42 which can fit into gaps 44 provided in the rear part 33 of the base.

Consequently, when the latch arrangement is pushed inwardly towards the base, it pivots about the pins 43 and the upstanding latch brackets 42 pass into the gaps 44 and frictionally engage with the side surfaces of the gaps 44 thereby locking the front section against the sliding movement along the rails thereby locking the position of the front section 26. Pulling the latch arrangement outwardly from the base unlocks the position of the front section enabling it to be slidably moved between the walking and skiing positions. Alternative arrangements for locking the position of the front section can be devised, the details of which will be readily apparent to those skilled in the art. Preferably, the latch arrangement is a single integrally formed piece.

The ski boot device may be made from any sufficiently durable material, for example military grade plastics and rubbers.

It will be apparent that the present invention is capable of modification, the details of which will be readily apparent to those skilled in the art. For example, whilst the fifth embodiment is described with a front boot holder 22 and a rear boot holder 23, one or both of these can be omitted with the ski boot device being screwed into the sides of the front sole 3 or rear sole 4 in similar manner to that shown in FIG. 2. Likewise, one or both of the holders can be omitted with the ski boot device being integrally formed with the front sole and rear sole in a similar manner to that shown in FIGS. 4A and 4B. It will be apparent that one or both of the front boot holder 22 and rear boot holder 23 can be used to tighten the ski boot device onto a ski boot. It is further apparent that any of the above embodiments can be formed to be an integral part of a ski boot.

The invention claimed is:

1. A ski boot device fastened to a ski boot, the ski boot having a sole including a front sole section having a bottom surface including a front interaction portion which interacts with a ski binding and a rear portion, an intermediate sole section, and a rear sole section having a bottom surface including a front portion and a rear interaction portion which interacts with the ski binding, the front sole and rear sole section bottom surfaces being arranged in a common plane, said ski boot device comprising:

(a) first and second longitudinally extending side members each including a toe portion having a lower surface flattened profile, an intermediate portion having a shaped profile, and a heel portion having a lower surface flattened profile, respectively; and (b) a plurality of attachment elements adapted for fastening said first and second side member toe portions to opposite side surfaces of the ski boot front sole section above the common plane and said first and second side member heel portions to opposite side surfaces the ski boot rear sole section above the common plane, said first and second side members being fastened to the ski boot with said side member toe and heel lower surface flattened portions lying in the common plane and said side member intermediate portions extending below the common plane and between the front and rear interaction portions, respectively, without interfering with the ski binding, said ski boot device is adapted for use during both walking and skiing.

2. The ski boot device as claimed in claim 1, further comprising a bridge member extending laterally between said first and second side member intermediate portions to provide an additional contact surface during walking.

3. The ski boot device as claimed in claim 2, wherein said first and second side members and said bridge member are integrally formed as a unitary member.

4. The ski boot device as claimed in claim 1, wherein said first and second side members are identical.

5. The ski boot device as claimed in claim 1, wherein said plurality of toe portion attachment elements comprise screws for connecting side member toe portions to the side surfaces of the front sole section, and wherein said heel portion attachment elements comprise screws for connecting side member heel portions to the side surfaces of the rear sole section.

6. The ski boot device as claimed in claim 1, wherein said shaped profile comprises a curve.

* * * * *